US006682368B2

(12) United States Patent
Murr et al.

(10) Patent No.: US 6,682,368 B2
(45) Date of Patent: Jan. 27, 2004

(54) ELECTRICAL CONNECTOR ASSEMBLY UTILIZING MULTIPLE GROUND PLANES

(75) Inventors: Keith McQuilkin Murr, Etters, PA (US); Robert Alan Kirker, Harrisburg, PA (US)

(73) Assignee: Tyco Electronics Corporation, Middletown, PA (US)

( * ) Notice: Subject to any disclaimer, the term of this patent is extended or adjusted under 35 U.S.C. 154(b) by 0 days.

(21) Appl. No.: 10/147,151

(22) Filed: May 16, 2002

(65) Prior Publication Data

US 2002/0142636 A1 Oct. 3, 2002

Related U.S. Application Data

(63) Continuation-in-part of application No. 09/584,229, filed on May 31, 2000, now Pat. No. 6,431,887.

(60) Provisional application No. 60/341,412, filed on Dec. 17, 2001.

(51) Int. Cl.[7] ..... H01R 13/648

(52) U.S. Cl. ..... 439/607; 439/939

(58) Field of Search ..... 439/607, 108, 439/939, 101, 95, 79

(56) References Cited

U.S. PATENT DOCUMENTS

| | | | | | |
|---|---|---|---|---|---|
| 5,067,914 | A | * | 11/1991 | Seidel et al. | 439/609 |
| 5,766,027 | A | | 6/1998 | Fogg | |
| 5,865,646 | A | * | 2/1999 | Ortega et al. | 439/607 |
| 6,203,373 | B1 | * | 3/2001 | Lin | 439/607 |
| 6,276,943 | B1 | | 8/2001 | Boutros et al. | |
| 2001/0044227 | A1 | | 11/2001 | Boutros et al. | |

* cited by examiner

*Primary Examiner*—Tho D. Ta

(57) ABSTRACT

An electrical connector assembly including an insulated receptacle housing, an electrical plug, and a ground shield is provided. Plug contacts within the electrical plug engage receptacle contacts within the receptacle housing. The ground shield includes top, bottom and side walls that at least partially enclose the receptacle housing and has an opening in the front face through which the electrical plug is inserted. First and second sets of ground contacts are formed integral with at least one of the top, bottom and side walls. The first set of ground contacts projects inward to form at least one plug contact point and plug ground plane with the electrical plug. The second set of ground contacts projects outward to form at least one external contact point and external ground plane with an external structure. The external and plug ground planes are located at different distances from the front face.

33 Claims, 8 Drawing Sheets

ELECTRICAL CONNECTOR ASSEMBLY UTILIZING MULTIPLE GROUND PLANES

RELATED APPLICATIONS

This application is a continuation-in-part of application Ser. No. 09/584,229, filed May 31, 2000, U.S. Pat. No. 6,431,887, titled "Electrical Connector Assembly With an EMI Shielded Plug and Grounding Latch Member," the complete subject matter of which is incorporated herein by reference in its entirety. This application is also related to, and claims priority from, Provisional Application No. 60/341,412 filed Dec. 17, 2001, titled "High Speed Serial Electrical Connector", the complete subject matter of which is incorporated herein by reference in its entirety.

BACKGROUND OF THE INVENTION

Certain embodiments of the present invention generally relate to electrical cable assemblies for use with high speed serial data, and more particularly, to connector assemblies for transferring high speed serial data from a cable to a circuit board.

In the past, cable assemblies have been proposed for connecting electrical cable to circuit boards. Conventional cable assemblies have been provided with an equalizer circuit board within the connector for performing signal conditioning. Performing signal conditioning within a circuit in the connector assembly reduces the time required to incorporate signal conditioning circuit elements with a cable assembly and reduces the time required for connection of the circuit elements with the electrical contacts and the cable conductors. One example of a conventional cable assembly with an equalizer board is described in U.S. Pat. No. 5,766,027, commonly owned with the present application. Conventional high speed serial data connectors (HSSDC) comprise a plug and receptacle combination interconnected through contact fingers. The plug receives an insulated holder that, in turn, receives an equalizer card. The equalizer card includes signal conditioning circuitry.

Both the equalizer card and the data being transferred through the cable are highly susceptible to electromagnetic interference (EMI). Electromagnetic radiation (EM) may be generated by computing and other electronic devices, television, cellular phones, and the like. EMI from one device may interfere with other devices in the surrounding area causing data corruption and/or malfunction of the affected device. Therefore it is advantageous to shield the receptacle and plug to prevent the connector assembly from both interfering with, and being negatively impacted by, other devices that are susceptible to EMI or that generate EM radiation.

Conventional connectors use sheet metal, which either absorbs or reflects electromagnetic radiation, to construct the plug and receptacle. The sheet metal is folded into a desired configuration to form the receptacle. Ground beams, or contacts, are formed integral with the receptacle to provide ground connections with the plug and an external chassis. Traditionally, a single ground plane has been believed to provide the greatest protection from EMI. Therefore, the ground beams have been located to form a single ground plane that is positioned to align with the chassis of a computer, cabinet, external structure, and the like to which the connector is mounted. The ground plane partially surrounds the adjoining surfaces of the receptacle and plug in order to afford EMI shielding around the contact fingers forming the high speed serial data connection between the plug and receptacle. In conventional connectors, a plurality of ground beams are located on the top, bottom and side walls of the receptacle which engage the respective top, bottom and side surfaces of the plug within the single ground plane.

The number of ground beams is limited by the desired size of the receptacle. Therefore, increasing the number of ground beams also increases the complexity at the ground plane location. Additionally, in order to maintain a single ground plane aligned with the chassis, the ground beams have been short by necessity. As a result, one or more ground beams may lose resiliency, or memory, resulting in a poor grounding connection, an increased radiation of EM, and/or an increased susceptibility to EMI.

A need exists for a connector assembly that improves the EMI effectiveness of the receptacle without sacrificing its electrical performance or latching abilities. It is an object of certain embodiments of the present invention to meet these needs and other objectives that will become apparent from the description and drawings set forth below.

BRIEF SUMMARY OF THE INVENTION

In accordance with at least one embodiment, an electrical connector assembly is provided. The electrical connector assembly includes an insulated receptacle housing, an electrical plug, and a ground shield. The insulated receptacle housing holds receptacle contacts within a plug reception chamber in which the electrical plug is accepted. The electrical plug holds plug contacts which engage the receptacle contacts. The ground shield includes top, bottom and side walls that at least partially enclose the insulated receptacle housing. The ground shield has an opening in the front face through which the electrical plug is inserted in the plug reception chamber. First and second sets of ground contacts are formed integral with at least one of the top, bottom and side walls. The first set of ground contacts project inward from at least one of the top, bottom and side walls to form at least one plug contact point with the electrical plug and at least one plug ground plane. The second set of ground contacts project outward from at least one of the top, bottom and side walls to form at least one external contact point with an external ground structure. The second set of ground contacts define at least one external ground plane which differs from the plug ground plane.

In accordance with at least one embodiment, an electrical connector is provided. The electrical connector includes an insulated receptacle housing, a plug member, and a ground shield. The plug member connects to the insulated receptacle housing within a receptacle opening. The plug member holds plug contacts which engage the receptacle contacts held within a receptacle opening of the insulated receptacle housing. The ground shield has top, bottom, side and rear walls which surround the insulated receptacle housing, and an opening in a front face to receive the plug member. Ground contacts are stamped and formed integral with at least one of the top, bottom and side walls. The ground contacts include a first ground contact which extends outward from the ground shield and forms an external contact point with an external ground structure. The external contact point is spaced a first distance from the front face. The ground contacts also include a second ground contact which extends inward from the ground shield and forms a plug contact point with the plug member. The plug contact point is spaced a second distance from the front face which is different from the first distance.

In accordance with at least one embodiment, an electrical connector receptacle is provided. The electrical connector receptacle includes an insulated housing and a conductive ground shield. The insulated housing holds receptacle contacts within a receptacle opening. The conductive ground shield is bent to surround the receptacle housing and has top, bottom, side and rear walls which are formed integral with one another. The shield has an opening in a front face to receive a plug member which has at least one conductive exterior surface. Ground contacts are stamped and formed integral with at least one of the top, bottom and side walls. A first set of ground contacts electrically engages a conductive chassis of a support structure at first contact points which are spaced a first distance from the front face. A second set of ground contacts electrically engages the plug member at second contact points spaced a second distance from the front face.

In accordance with at least one embodiment, an electrical receptacle connector including an insulated housing and a ground shield is provided. The insulated housing has an opening in a front end and an interior chamber holding receptacle contacts having ends which extend from the housing. The opening communicates with the interior chamber and is adapted to receive an electrical plug that engages the receptacle contacts. The ground shield has top, bottom and side walls that at least partially enclose the insulated receptacle housing. The ground shield has an opening in a front face through which the electrical plug is inserted into the interior chamber. First and second sets of ground contacts are formed integral with at least one of the top, bottom and side walls. The first set of ground contacts projects inward from at least one of the top, bottom and side walls forming at least one plug contact point with the electrical plug to define at least one plug ground plane. The second set of ground contacts projects outward from at least one of the top, bottom and side walls forming at least one external contact point with an external ground structure to define at least one external ground plane which is different from the plug ground plane.

BRIEF DESCRIPTION OF SEVERAL VIEWS OF THE DRAWINGS

The foregoing summary, as well as the following detailed description of the preferred embodiments of the present invention, will be better understood when read in conjunction with the appended drawings. For the purpose of illustrating the invention, there is shown in the drawings embodiments which are presently preferred. It should be understood, however, that the present invention is not limited to the precise arrangements and instrumentality shown in the attached drawings.

DETAILED DESCRIPTION OF THE INVENTION

Figure 1:
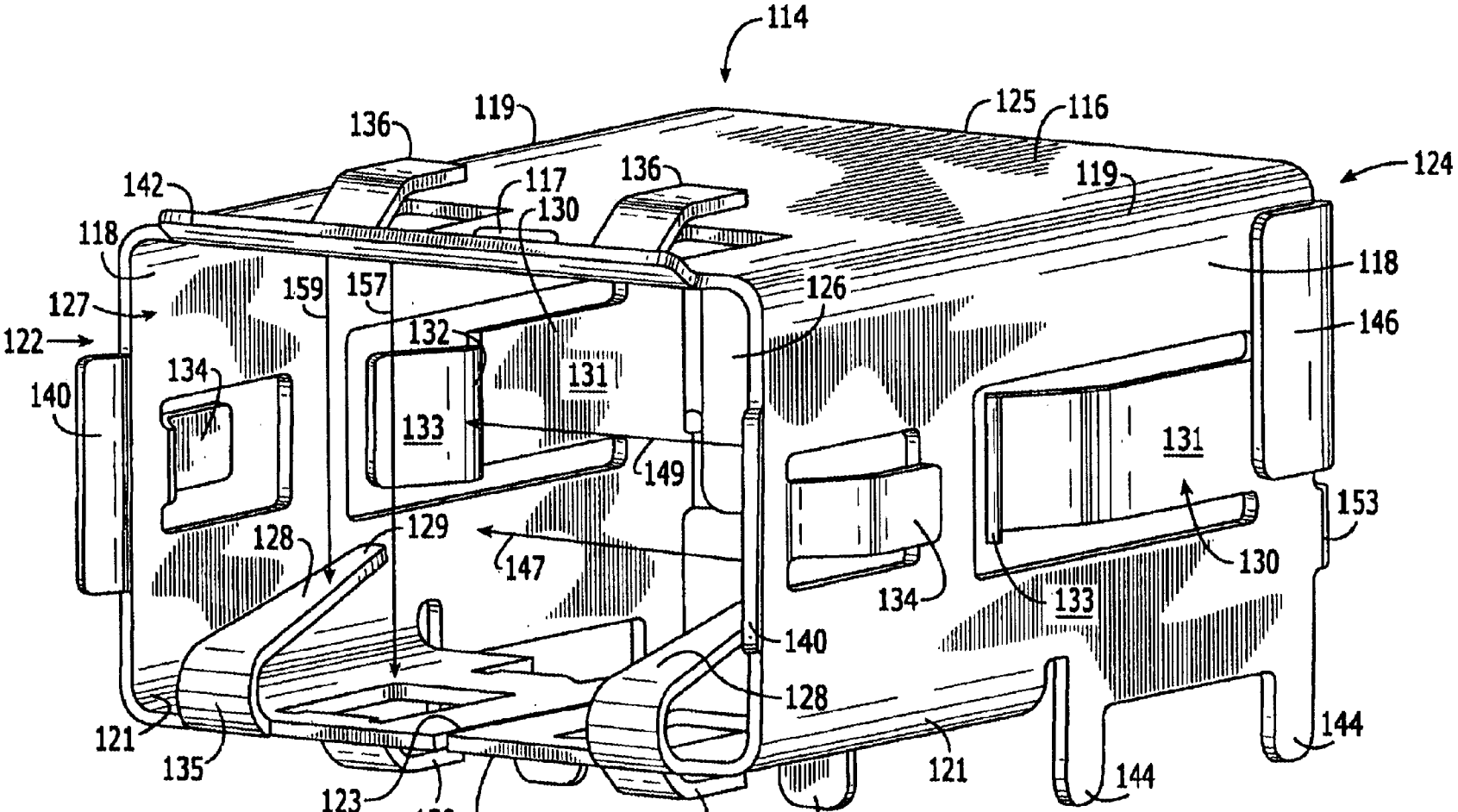
FIG. 1 illustrates a front perspective view of a receptacle shield formed in accordance with an embodiment of the present invention.

FIG. 1 illustrates a front perspective view of a socket or receptacle shield 114 formed in accordance with an embodiment of the present invention. The receptacle shield 114 snappingly receives and is secured to a plug assembly 100 (FIG. 2) to form a mating electrical connection therebetween. The receptacle shield 114 includes a top 116, sides 118 and bottom 120 forming four walls that define a front face 122 with an opening 127 to receive the plug assembly 100. A rear face 124 is closed with a back wall 126.

Figure 3:
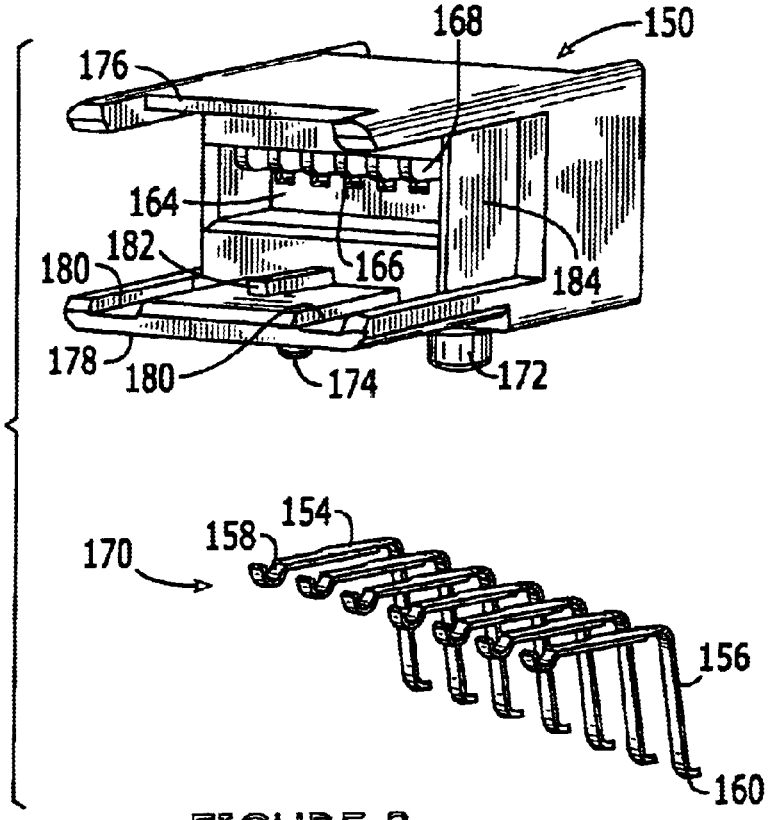
FIG. 3 illustrates a perspective view of an insulated housing and contact fingers formed in accordance with an embodiment of the present invention.

The receptacle shield 114 may be formed of a single piece of sheet material folded to enclose an insulated housing 150 (FIG. 3). The receptacle shield 114 may be formed by bending the sheet material down along top curves 119 to form sides 118. The receptacle shield 114 is then bent upward and inward at bottom curves 121 along the bottom of each side 118 to form the bottom 120. The front region 161 (FIG. 6) of the bottom 120 is formed with a parallel plane of the sheet material joined at a center line 123. The sheet material is bent down from the plane of the top 116 along back curve 125 to form the back wall 126. The back wall 126 includes tabs 146 projecting outward from either side thereof. The tabs 146 are folded forward to overlay a rear portion of the sides 118 to cover the seams formed between the back wall 126 and sides 118 when the receptacle shield 114 is folded into a desired shape. The sides 118 include tabs 153 projecting backward toward rear face 124. The tabs 153 are folded backward to overlay a portion of the back wall 126 to cover the seams formed between edges of the back wall 126 and sides 118.

Figure 2:
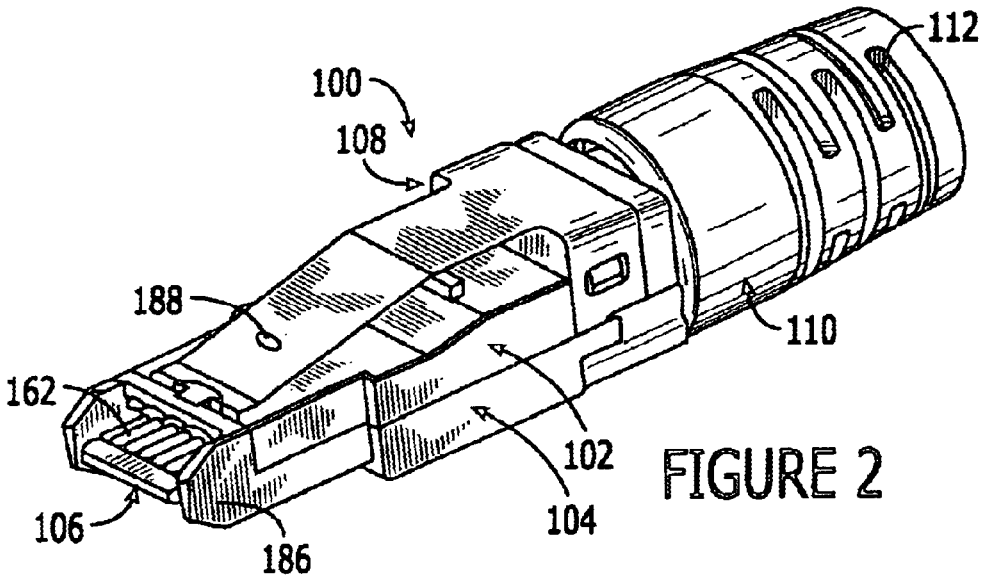
FIG. 2 illustrates a perspective view of a plug assembly formed in accordance with an embodiment of the present invention.

FIG. 2 illustrates a perspective view of a plug assembly 100 configured in accordance with an embodiment of the present invention. The plug assembly 100 includes an upper shell 102 and a lower shell 104 enclosing a PC equalization board 106 comprising contact pads 162 on one end thereof. The plug assembly 100 includes guide wings 186 for guiding the plug assembly 100 into the insulated housing 150. The plug assembly 100 also includes a latch assembly 108 removably mounted to the upper and lower shells 102 and 104. The plug assembly 100 may be securely mounted to the end of a cable capable of transmitting high speed serial data, such as a quad cable and the like. A strain relief 110 is secured to the back end of the upper and lower shells 102 and 104 to protect the interconnection between the plug assembly 100 and the cable. The strain relief 110 includes multiple notches 112 cut therein to afford flexibility to the strain relief 110. The upper and lower shells 102 and 104 are formed through diecast molding of a conductive material, such as zinc, magnesium and the like. The latch assembly 108 is stamped and formed of phosphorous bronze, brass and the like. Therefore, at least one exterior surface of the plug assembly 100 is conductive.

FIG. 3 illustrates the insulated housing 150 and a plurality of contact fingers 170 to be mounted therein. Each contact finger 170 is formed in an L-shape with horizontal and vertical legs 154 and 156. The horizontal legs 154 include a spoon-shaped contact region 158 on an outer end, while vertical legs 156 include an elbow-shaped contact region 160 on the opposite end. The spoon-shaped contact regions 158 frictionally engage contact pads 162 on the PC equalization board 106. The elbow-shaped contact regions 160 may be soldered to surface mounted contact pads on a motherboard (not shown), to which the receptacle shield 114 may be securely mounted. The housing 150 includes a plug receiving opening 164 therein that accepts the front edge of the PC equalization board 106. The opening 164 includes a plurality of projections 166 extending downward from an upper edge of the opening 164 to define recessed slots 168 therebetween.

Figure 4:
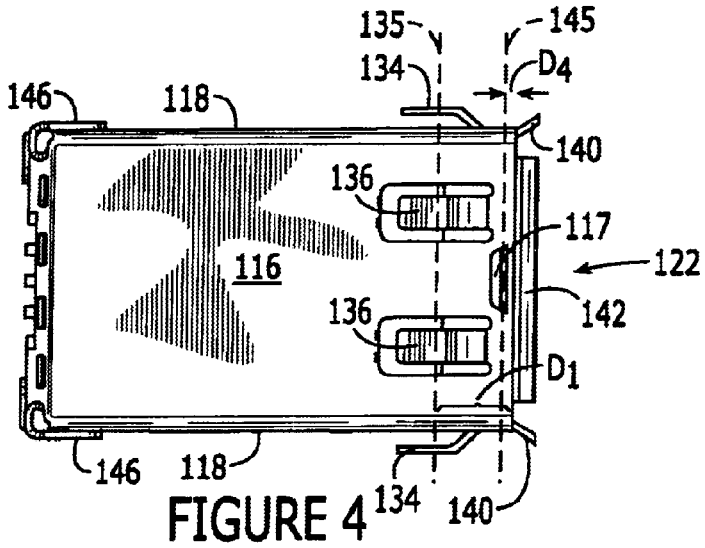
FIG. 4 illustrates a top plan view of a receptacle shield formed in accordance with an embodiment of the present invention.

FIG. 4 illustrates a top view of the receptacle shield 114. The sides 118 include guide flanges 140 and 142 provided at the front face 122 to guide the plug assembly 100 into the opening 127. Guide flanges 140 and 142 are integral with the single piece of material used to form the top 116 and sides 118. The top 116 includes a pair of ground contacts 136 stamped and formed therein, while ground contacts 134 are stamped and formed in the sides 118.

Figure 5:
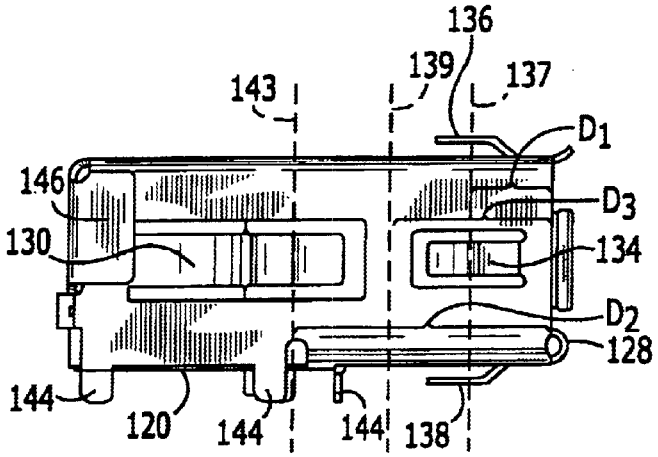
FIG. 5 illustrates a side plan view of a receptacle shield formed in accordance with an embodiment of the present invention.

FIG. 5 illustrates a side view of the receptacle shield 114. The sides 118 include ground contacts 130 stamped and formed to project inward into an interior chamber. The bottom 120 includes ground contacts 138 stamped and formed therein to project downward. A plurality of tabs 144 are integral with and extend downward from bottom edges of the sides 118 and bottom 120 of the receptacle shield 114. The tabs 144 are received in holes in the motherboard and may be press fit or soldered thereto.

Figure 6:
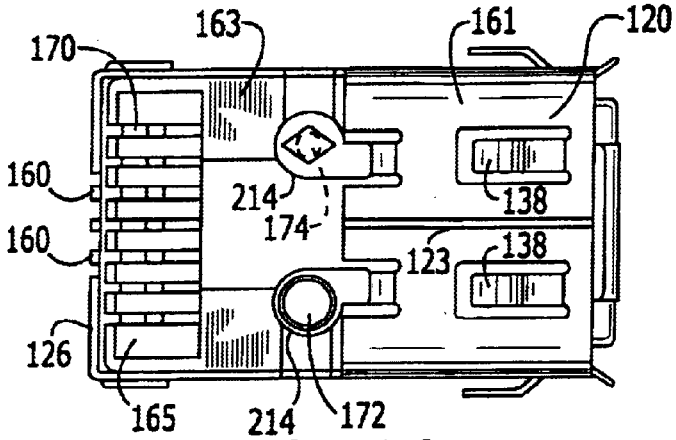
FIG. 6 illustrates a bottom plan view of a receptacle shield with an insulated housing and contact fingers mounted therein in accordance with an embodiment of the present invention.

FIG. 6 illustrates a bottom view of the receptacle shield 114 with the insulated housing 150 and contact fingers 170 installed. The bottom 120 includes front and back regions 161 and 163. Front and back regions 161 and 163 may be comprised of a single sheet of material. Optionally, back region 163 may be open, in order to expose the corresponding portion of the insulated housing 150. A contact area 165 provides an opening to expose the contact regions 160 of the contact fingers 170 near the back wall 126. The contact regions 160 are surface mounted upon contacts on the motherboard in order to provide electrical connections between the motherboard and cable via the PC equalization board 106 and contact fingers 170. The bottom of the housing 150 includes standoffs 214 that define a spacing maintained between the bottom of the housing 50 and a circuit board to which the receptacle shield 114 is mounted. The pins 172 and 174 are formed integral with the standoffs 214. The pins 172 and 174 are inserted through holes in the motherboard. Optionally, pin 174 may be constructed with a diamond or other non-circular cross-section to permit easy installation on the motherboard, while maintaining proper alignment.

Ground contacts 134, 136 and 138 project outward from the sides 118, top 116 and bottom 120, respectively, and maintain separate points of contact with the metal chassis of a support structure such as a computer. The ground contacts 134, 136, and 138 are provided with contact surfaces, all of which may be centered upon an external or chassis ground plane 137 that is located a distance $D_1$ from the front face 122. By way of example, the centers of the contact surfaces of the ground contacts 134, 136, and 138 are spaced distance $D_1$ from the front edges of the top 116, sides 118 and bottom 120. For example, ground contacts 134 and 136 may be stamped in the sides 118 and top 116 to evenly surround the front face 122, or may be evenly distributed among the sides 118 and top 116. Alternatively, ground contacts 134, 136, and 138 may maintain points of contact with the metal chassis within more than one external ground plane by being stamped and formed different distances from the front face 122. Therefore, it should be understood that the location of ground contacts 134, 136, and 138 is not limited to the locations and configuration illustrated in FIGS. 1 and 4–6.

The sides 118 of the receptacle shield 114 include ground contacts 130 located near the rear end of the sides 118. The ground contacts 130 project inward and extend forward toward the front face 122. The ground contacts 130 include base sections 131 that may be rectangular in shape punched out of sides 118. The base sections 131 join outer ends 133 of the ground contacts 130 that are bent to form ramped surfaces 132 projecting inward into the interior of the receptacle shield 114. Thus, the interior width 147 of the receptacle shield 114 as measured between sides 118 is greater than the interior width 149 as measured between the ramped surfaces 132 of the ground contacts 130. The ramped surfaces 132 engage the guide wings 186 (FIG. 2) on either side of the plug assembly 100 as the guide wings 186 enter notches 184 (FIG. 3) along either side of the insulated housing 150 to form grounding points therewith. The grounding points define a plug ground plane 143. The plug ground plane 143 is spaced a distance $D_3$ from the front face 122 and occupies a different ground plane than the chassis ground plane 137.

Each ground contact 128 includes a flexible base 135 and an outer tip 129. Ground contacts 128 are formed integral with the bottom 120 and project forward, upward and into the opening 127 in the front face 122. The outer tip 129 need not be at the absolute outer end of the ground contacts 128, but instead represents the portion of the ground contacts 128 that are configured to contact the plug assembly 100. Therefore, the interior height 157 of the receptacle shield 114 as measured between top 116 and bottom 120 is greater than the interior height 159 as measured between the top 116 and the outer tip 129. The ground contacts 128 are biased inward to contact the bottom surface of the lower shell 104 with outer tip 129 to form grounding connections between the bottom surface of the plug assembly 100 and the receptacle shield 114. As the flexible base 135 of ground contacts 128 is longer than similar contacts that provide a connection within the ground plane of the metal chassis, ground contacts 128 are more resilient (or elastic) and afford better memory retention, thus providing a consistent and reliable grounding connection between receptacle shield 114 and plug assembly 100 even after multiple connections and disconnections.

As illustrated on FIG. 1, ground contacts 128 extend into the receptacle shield 114 to form a plug ground plane 139 between the point of contact between the outer tip 129 and plug assembly 100. The plug ground plane 139 is located deeper within the receptacle shield 114 than the chassis ground plane 137. More specifically, the plug ground plane 139 is located a distance $D_2$ from the front face 122, where distance $D_2$ is greater than distance $D_1$. In addition, the plug ground plane 139 formed between outer tips 129 and plug assembly 100 is closer to the front face 122 than the ground plane 143 formed by ground contacts 130 and plug assembly 100. Therefore, the outer tip 129 of ground contacts 128 maintains electrical contact with the plug assembly 100 in a plug ground plane 139 which is different than the plug ground plane 143 formed by the ground contacts 130.

A hole 117 is stamped out of the top 116 to provide a point of contact between the receptacle shield 114 and the plug assembly 100 when the hole 117 engages locking member 188 on the plug assembly 100. The hole 117 provides contact between the receptacle shield 114 and the plug assembly 100 within a plug ground plane 145 located at a distance $D_4$ from the front face 122. The hole 117 may be located in the same or a different ground plane as one or more of ground contacts 134, 136 and 138, depending upon the location of ground contacts 134, 136, and 138 relative to the front face 122.

Figure 7:
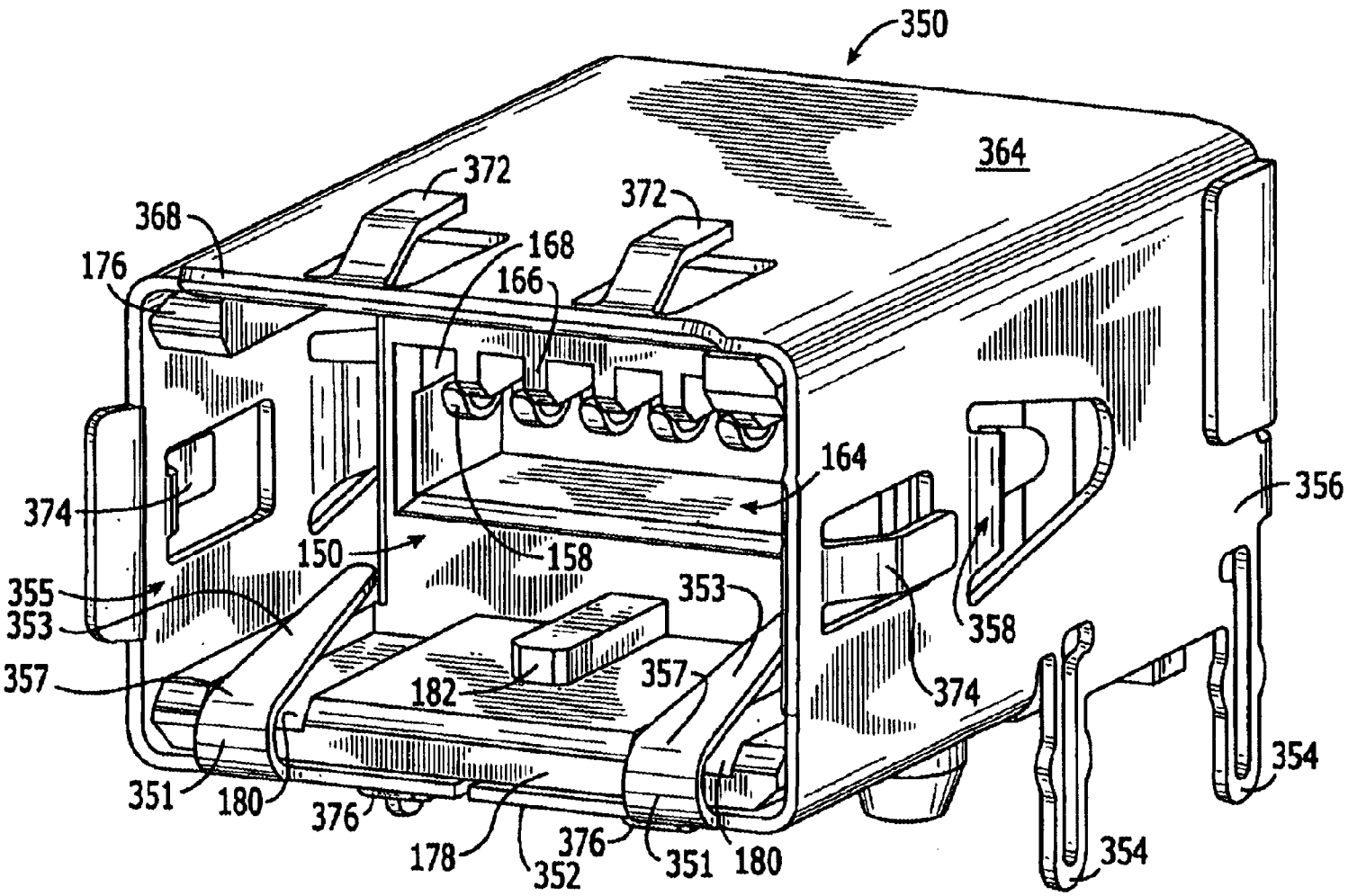
FIG. 7 illustrates a front view of a receptacle shield with an insulated housing and contact fingers mounted therein in accordance with an embodiment of the present invention.

FIG. 7 illustrates a front view of a receptacle shield 350 with an insulated housing 150 and contact fingers 170 mounted therein. The receptacle shield 350 is formed of a single piece of sheet material as previously discussed in relation to receptacle shield 114. FIG. 7 includes ground contacts 357 with a flexible base 351 formed integral with the bottom 352. The flexible base 351 is bent upward and inward into the front face 355, and the beam 353 portion of the ground contacts 357 extends into the interior of receptacle shield 350. The bottom 352 includes tabs 354 which project downward and may be snappingly received by the motherboard and/or securely soldered thereto.

The following discussion refers to FIGS. 2, 3, and 7. Turning first to FIG. 3, a plurality of contact fingers 170 with spoon-shaped contact regions 158 are mounted within the interior chamber of the insulated housing 150. The slots 168 receive the horizontal legs 154 of the contact fingers 170. The housing 150 maintains the contact fingers 170 in a predetermined position and orientation by frictionally mounting the horizontal legs 154 of the contact fingers 170 in the slots 168 between the projections 166.

The pins 172 and 174 are received through holes in the receptacle shield 350 and motherboard to align, and secure in place, the housing 150. Optionally, the receptacle shield 350 may not fully enclose the housing 150. Thus, the pins 172 and 174 may be secured directly to the motherboard. The housing 150 includes upper and lower ledges 176 and 178 projecting forward from a body. The lower ledge 178 includes grooves 180 and a polarizing key 182. The upper and lower ledges 176 and 178 cooperate to guide the plug assembly 100 into the opening 164 in the receptacle shield 350. Opposite sides of the housing 150 include recessed notches 184 to receive the guide wings 186 on the plug assembly 100.

Figure 8:
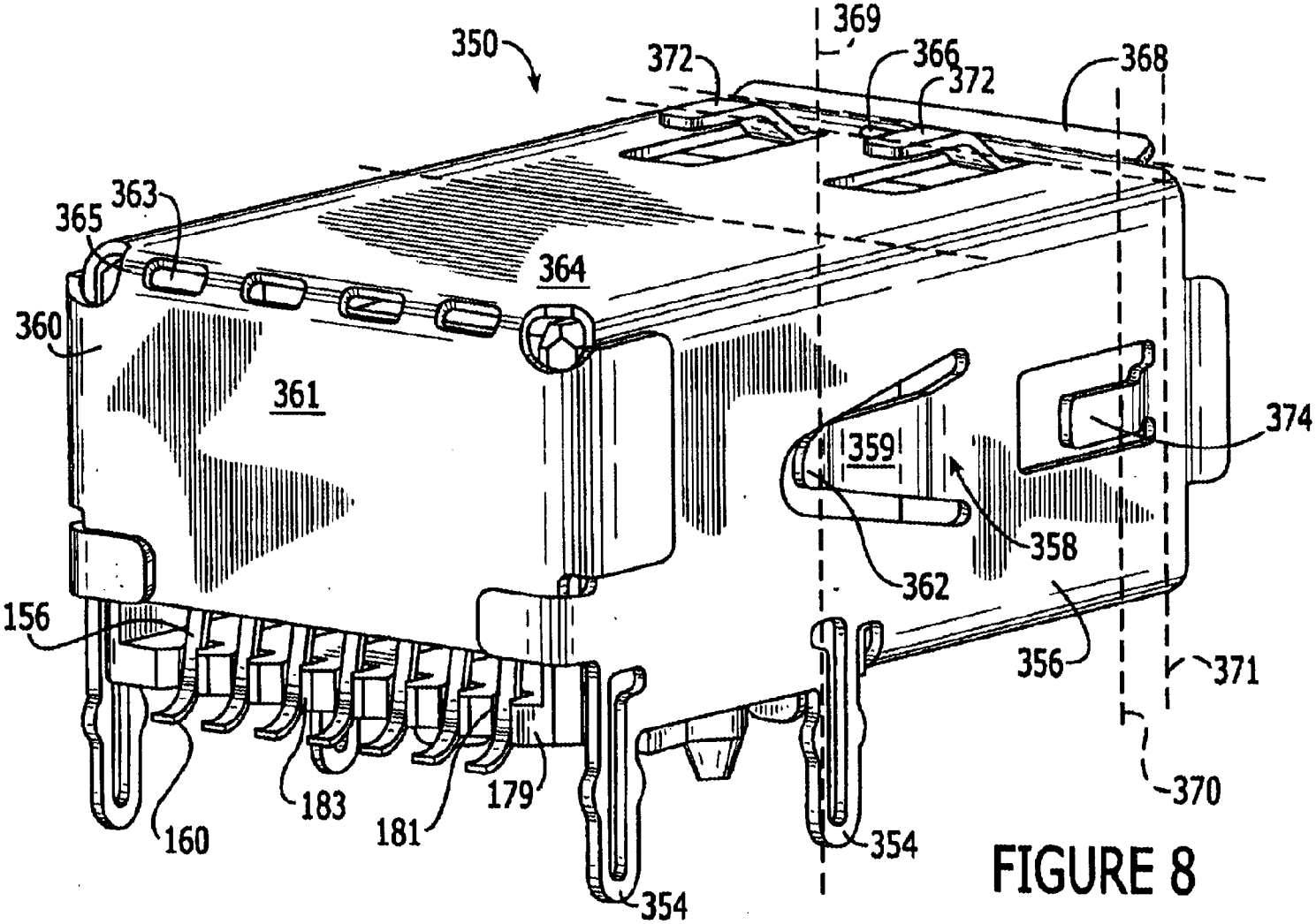
FIG. 8 illustrates a back perspective view of a receptacle shield with an insulated housing and contact fingers installed therein in accordance with an embodiment of the present invention.

FIG. 8 illustrates a back perspective view of the receptacle shield 350 with the insulated housing 150 and contact fingers 170 installed therein. The back wall 361 is integrally formed with the top 364. The back wall 361 extends downward to partially enclose the rear face 360. Vertical legs 156 and contact region 160 are visible below the back wall 361. The rear ledge 179 provides recessed slots 181 between projections 183 in order to maintain the contact fingers 170 in a predetermined position and orientation. One or more slits 363 may be punched in the sheet material along the back curve 365. Additional tabs integral with the back wall 361 may be included proximate the rear ledge 179. The tabs may be bent inward and upward around the rear ledge 179 and against insulated housing 150. The top 364 includes a hole 366 near the guide flange 368 to receive a locking member 188 on the plug assembly 100.

The top 364, sides 356 and bottom 352 of the receptacle shield 350 include ground contacts 372, 374, and 376, respectively. Ground contacts 372, 274, and 276 project outwardly to engage an external structure in chassis ground plane 370. The sides 356 of the receptacle shield 350 include ground contacts 358. The ground contacts 358 project inwardly and towards the rear face 360. The ground contacts 358 include base sections 359 punched out of sides 356. Outer ends 362 of the ground contacts 358 are bent to form ramped surfaces similar to the ramped surfaces 132 of FIG. 1. The outer ends 362 of the ground contacts 358 may be tapered in shape. As illustrated in FIGS. 7 and 8, ground contacts 358 engage receptacle shield 150 in a plug ground plane 369 further towards the back wall 361 than the chassis ground plane 370. In comparison with FIG. 1, the plug ground plane 369 formed by ground contacts 358 may be located closer to the back wall 361 of receptacle shield 350 than the plug ground plane 143 formed by the insulated housing 150 and ground contacts 130 of receptacle shield 114. In addition, the ground contacts 358 form a plug ground plane 369 with the receptacle shield 350 that is different than the plug ground plane 371 formed by the hole 366 and the locking member 188 of the plug assembly 100.

Figure 9:
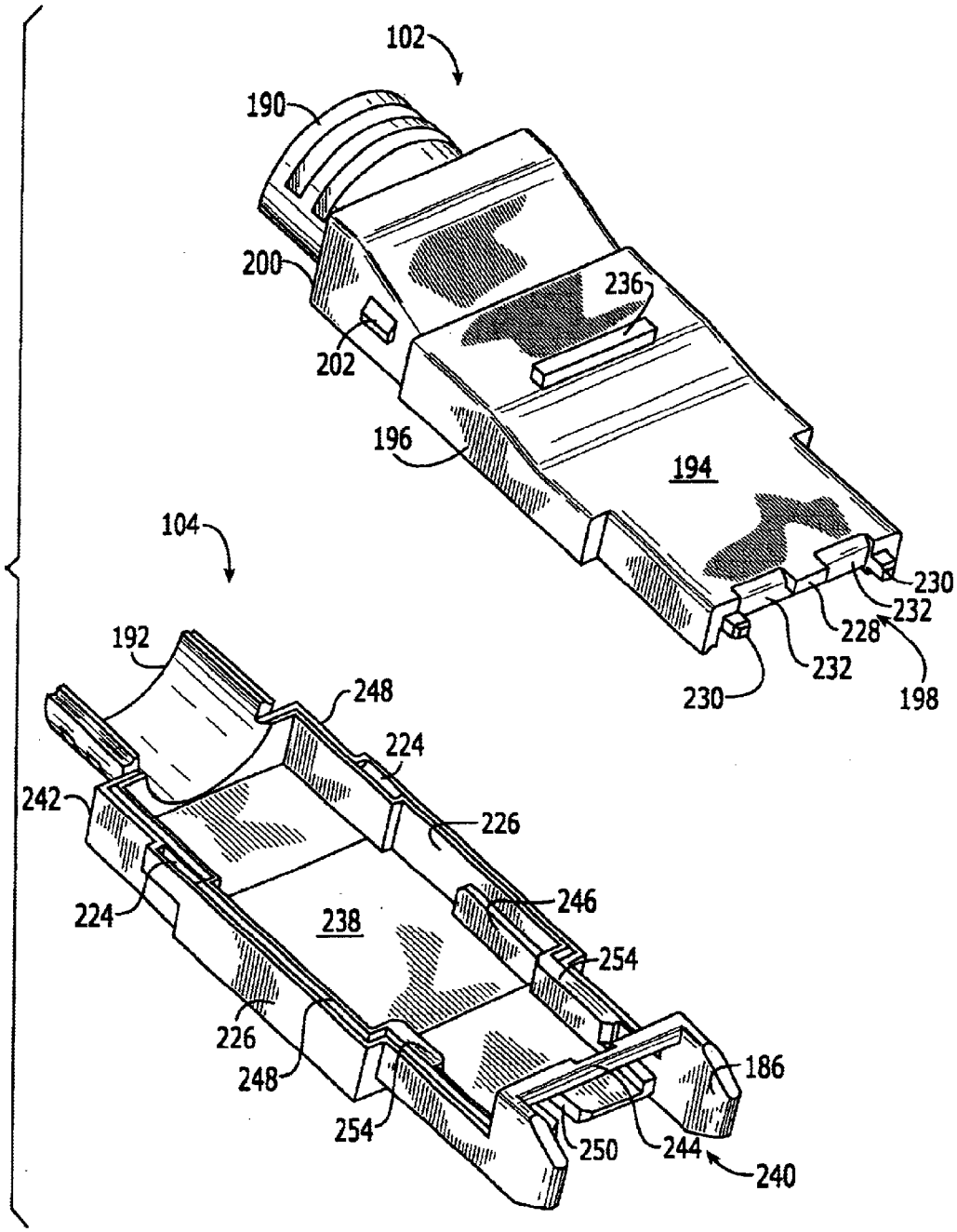
FIG. 9 illustrates a top perspective view of a receptacle shield formed in accordance with an embodiment of the present invention.

FIG. 9 illustrates a perspective view of upper and lower shells 102 and 104 included within plug assembly 100. The upper and lower shells 102 and 104 enclose the PC equalization board 106 and a wire organizer (not shown) that organizes and provides separation for the wires of the cable. The upper and lower shells 102 and 104 include upper and lower tubular sections 190 and 192 that combine to form a tubular opening through which the cable enters the plug assembly 100. The upper shell 102 includes a top 194, sides 196, a front face 198 and a back wall 200 formed integrally with one another. The back wall 200 is also integrally formed with the upper tubular section 190 to form a unitary upper shell 102. The sides 196 include opposed knobs 202 projecting outward therefrom.

Figure 10:
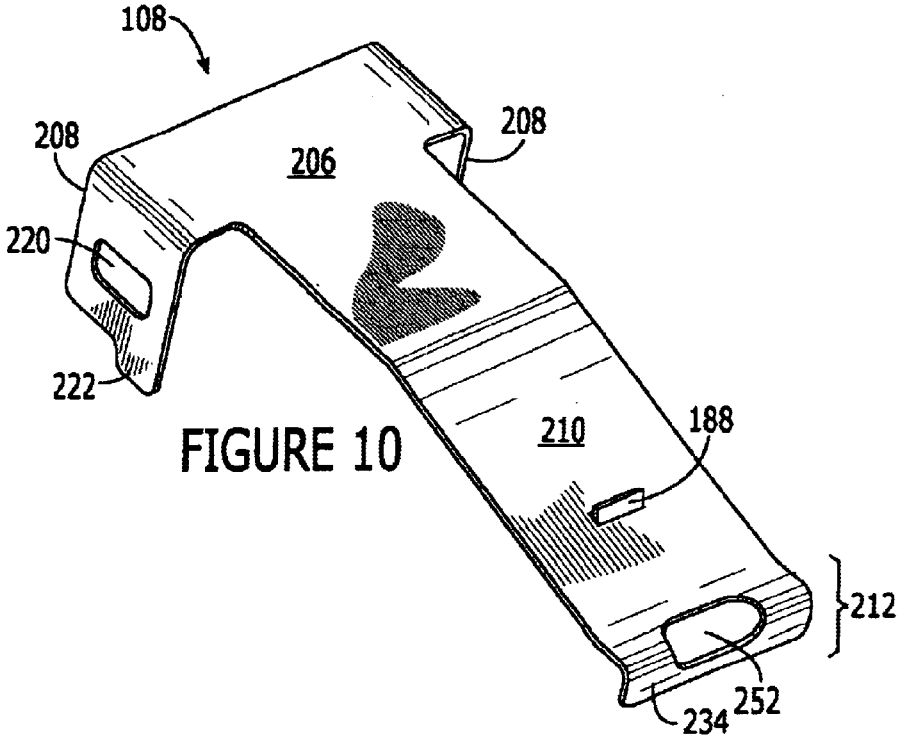
FIG. 10 illustrates a perspective view of upper and lower shells included within a plug formed in accordance with an embodiment of the present invention.
Figure 11:
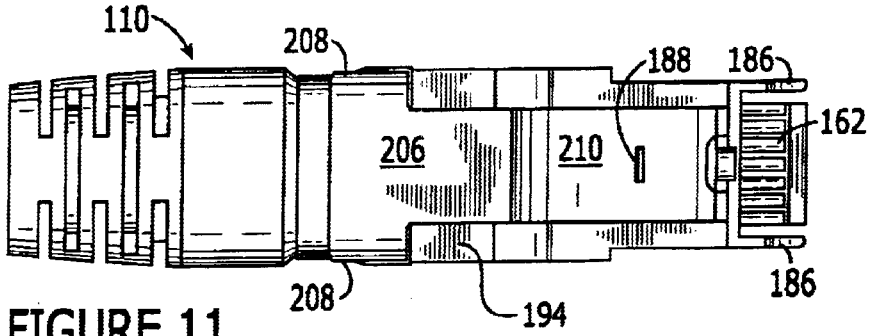
FIG. 11 illustrates a top plan view of a plug formed in accordance with an embodiment of the present invention.
Figure 12:
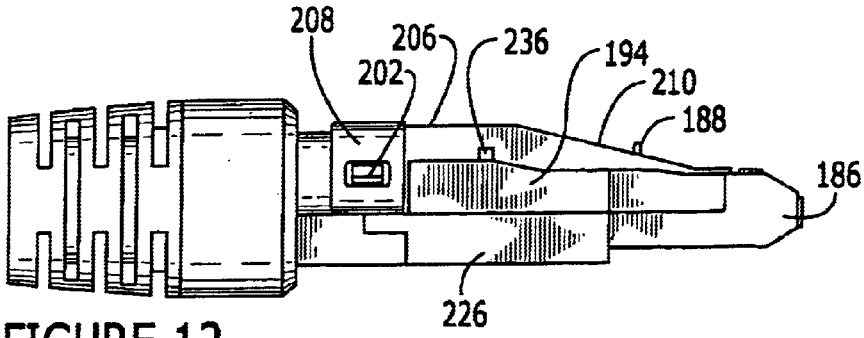
FIG. 12 illustrates a side plan view of a plug formed in accordance with an embodiment the present invention.
Figure 13:
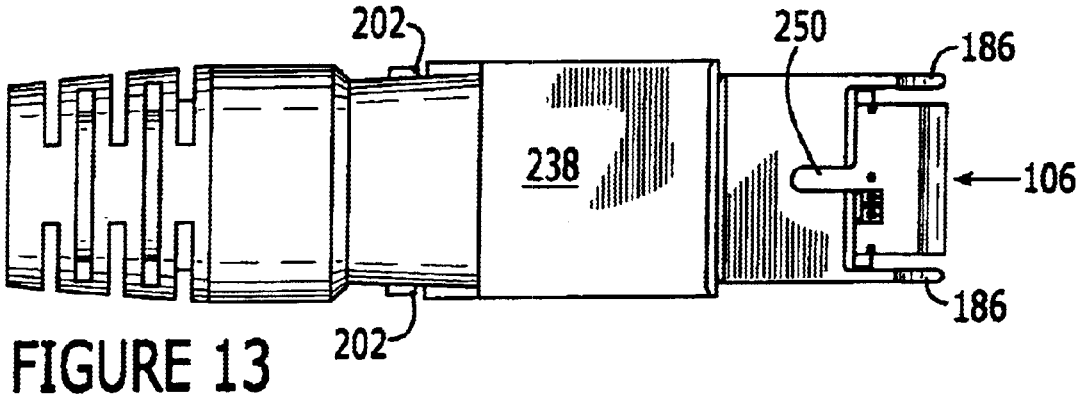
FIG. 13 illustrates a bottom plan view of a plug formed in accordance with an embodiment of the present invention.
Figure 14:
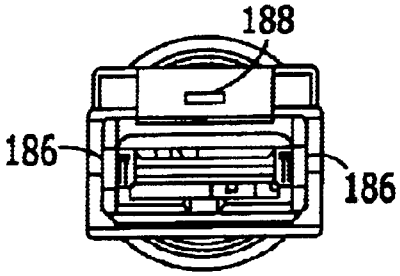
FIG. 14 illustrates a front plan view of a plug formed in accordance with an embodiment of the present invention.

FIG. 10 illustrates a perspective view of a latch assembly 108 mounted to the upper and lower shells 102 and 104. FIGS. 11–14 illustrate top, side, bottom and front views, respectively, of the plug assembly 100. The plug assembly 100 is described in more detail hereafter in connection with FIGS. 9–14.

The latch assembly 108 is formed of a single piece of sheet material and includes a T-shaped principle section 206, integrally formed with side flanges 208, a front or facing plate 210 and a leading section 212. The front plate 210 includes a locking member 188 extending upward. The guide flange 142 of receptacle shield 114 contacts the locking member 188 and biases the front plate 210 downward as the plug assembly 100 is inserted into the receptacle shield 114. The locking member 188 latchably engages hole 117 in the top 116 of the receptacle shield 114 when the plug assembly 100 is inserted in the receptacle shield 114. The side flanges 208 include holes 220 that are snapped over knobs 202 to secure the latch assembly 108 onto the upper shell 102. The side flanges 208 also include tabs 222 extending downward that are received within recesses 224 in either side 226 of the lower shell 104 when the upper and lower shells 102 and 104 are combined. The leading section 212 includes a hole 252 that receives a knob 228 projecting from the front face 198 of the upper shell 102. The front face 198 further includes pins 230 and U-shaped recesses 232. The U-shaped recesses 232 receive a lower lip portion 234 of the leading section 212 of the latch assembly 108.

A travel limiting projection 236 extends upward from the top 194 and is located below the T-shaped principle section 206 proximate the intersection of the T-shaped principle section 206 and front plate 210. The projection 236 is spaced below the principle section 206 by a distance sufficient to permit the latch assembly 108 to bend downward when the plug assembly 100 is moved into a mating connection with the receptacle shield 114. The projection 236 is constructed to limit the amount by which the latch assembly 108 is permitted to bend to prevent over straining the connection between the front plate 210 and principle section 206.

The lower shell 104 is constructed of a unitary diecast molded member including sides 226, bottom 238, a front face 240, and a rear wall 242. The rear wall 242 is formed integrally with the lower tubular section 192. The sides 226 include slotted recesses 224 that receive tabs 222 on the latch assembly 108 once assembled. The front edges of the sides 226 form the guide wings 186. The guide wings 186 are interconnected via a crossbar 244. The lower shell 104 further includes shelves 246 formed integrally upon the interior surface of the sides 226 to support the PC equalization board 106. Keys 254 are also formed integrally with the sides 226 to properly orient and align the PC equalization board 106. A skirt 248 is molded along the upper edge of the sides 226 to be received in a mating relation with the lower edges of the sides 196 of the upper shell 102. The skirts 248 form a sealed connection between the sides 226 and 196 of the upper and lower shells 102 and 104. The bottom 238 includes a slot 250 (FIG. 14) configured to receive a polarizing key 182 (FIG. 3) mounted on the top of the lower ledge 178 of the housing 150. Alternatively, the sides 226 may have one or more holes punched similar to holes 220 to receive tabs punched in sides 196 of upper shell 102. The tabs may be bent inward slightly and be snappingly received by the holes when the upper and lower shells 102 and 104 are joined.

The plug assembly 100 may be constructed as discussed below. The latch assembly 108 is mounted upon the upper shell 102 by locating the knob 228 in the hole 252 and the lower lip 234 in the U-shaped recess 232. The side flanges 208 are snapped downward over the sides 196 until the holes 220 receive the knobs 202. Once the PC equalization board 106 and cable are properly mounted within the plug assembly 100, and the plug assembly 100 is mounted within the lower shell 104, the upper shell 102 and latch assembly 108 are combined with the lower shell 104. To mount the upper and lower shells 102 and 104 to one another, the front face 198 of the upper shell 102 is inserted with the pins 230 located below the crossbar 244. The upper shell 102 is then rotated downward until tabs 222 are received within recesses 224 and the lower edge of the sides 196 securely mates with the skirt 248 on the upper edge of the sides 226. Once the tabs 222 are received within recesses 224, the side flanges 208 are held firmly against the sides 196 of the upper shell 102, thereby retaining the knobs 202 securely within the holes 220. The shield of the cable is slid over the upper and lower tubular sections 190 and 192, and a ferrule is slid over the shield and crimped in a frictional manner. The strain relief 110 is then pulled up over the ferrule.

The latch assembly 108 securely locks the plug assembly 100 within the receptacle shield 114, while the front plate 210 provides a grounding connection along a width of the front plate 210 between the top 194 of the upper shell and top 116 of the receptacle shield 114. The width of the latch assembly 108 may be varied to provide adequate grounding characteristics for EMI shielding and to provide a desired biasing force upward against top 116 of the receptacle shield 114. By way of example only, the front plate 210 may be as wide as the leading edge of the PC equalizer board 106.

The construction of the cable assembly will be discussed in relation to receptacle shield 114, although the following also applies when utilizing receptacle shield 350. The housing 150 is inserted within the receptacle shield 114 and mounted on the motherboard. The plug assembly 100 is assembled as explained above and mounted to the end of a cable, such as a quad cable capable of carrying high speed serial data. The plug assembly 100 is connected to the receptacle shield 114 by inserting the front face of the PC equalization board 106 into the opening 164 until contact pads 162 engage contact fingers 170. The front edges of the sides 118 and top 116 include guide flanges 140 and 142, respectively, that are flared outward to form a lead-in area to guide the face of the plug assembly 100 into the receptacle shield 114. The locking member 188 engages the hole 117 in the top 116 of the receptacle shield 114 in order to maintain the plug assembly 100 within the receptacle shield 114. The biasing forces applied by the latch assembly 108 maintain the locking member 188 within the hole 117. The latch assembly 108 maintains a grounding connection between the top of the plug assembly 100 and the top 116 of the receptacle shield 114. Ground contacts 130 maintain a grounding connection between the guide wings 186 of the plug assembly 100 and the sides 118 of the receptacle shield 114. Ground contacts 128 maintain grounding connections between the bottom of the plug assembly 100 and the bottom 120 of the receptacle shield 114.

As previously discussed, hole 117 and ground contacts 128 and 130 may maintain plug contact points within the system or chassis ground plane, or within one or more different plug ground planes. Additionally, ground contacts 134, 136, and 138 may maintain external contact points with the chassis within the system ground plane or within one or more different chassis ground planes. Therefore, by utilizing multiple ground planes, flexibility in location of ground contacts and the use of longer, more flexible ground contacts is provided. Longer ground contacts with increased flexibility and memory in turn provide improved mechanical and electrical connections between the receptacle shield and plug assembly.

In the above described embodiments, the plug and chassis ground planes are oriented perpendicular to a length of the receptacle shield, which may also be parallel to the front face. Alternatively, the chassis and/or plug ground planes may be oriented at an acute angle to the length of the receptacle shield. For example, the chassis and plug ground planes may form acute angles with the top and bottom and/or acute angles with the front face and/or side walls. Optionally, a single plug ground plane may be provided, or more than two plug ground planes. Optionally, the plug ground planes(s) may be aligned at an acute angle to the chassis ground plane. Optionally, multiple chassis ground planes may be provided.

While the invention has been described with reference to certain embodiments, it will be understood by those skilled in the art that various changes may be made and equivalents may be substituted without departing from the scope of the invention. In addition, many modifications may be made to adapt a particular situation or material to the teachings of the invention without departing from its scope. Therefore, it is intended that the invention not be limited to the particular embodiment disclosed, but that the invention will include all embodiments falling within the scope of the appended claims.

What is claimed is:

1. An electrical connector assembly comprising:

an insulated receptacle housing holding receptacle contacts within a longitudinally extending plug reception chamber;

an electrical plug for acceptance in said plug reception chamber of said insulated receptacle housing, said electrical plug holding plug contacts engaging said receptacle contacts; and a ground shield having top, bottom and side walls at least partially enclosing said insulated receptacle housing, said ground shield having an opening in a front face thereof through which said electrical plug is inserted in said plug reception chamber and a rear face opposite said front face, at least one of said top, bottom and side walls having first and second sets of ground contacts formed integral therewith, said first set of ground contacts projecting inward from said at least one of said top, bottom and side walls, said first set of ground contacts forming at least one plug contact point with said electrical plug to define at least one plug ground plane located between said front and said rear face, said second set of ground contacts projecting outward from said at least one of said top, bottom and side walls, said second set of ground contacts being configured to form at least one external contact point with an external ground structure to define at least one external ground plane located between said front face and said rear face, said external ground plane differing from said plug ground plane, each of said plug and external ground planes are spaced different first and second longitudinal distances from said front face of said ground shield.

2. The electrical connector assembly of claim 1, said first set of ground contacts including at least two plug ground contacts located proximate to said opening in said front face of said ground shield, said at least two plug ground contacts projecting into said plug reception chamber and forming corresponding plug contact points defining said plug ground plane.

3. The electrical connector assembly of claim 1, wherein said second set of ground contacts comprise chassis ground contacts formed integral with at least one of said top and side walls, said chassis ground contacts projecting outward from said ground shield, said chassis ground contacts being configured to electrically engage a conductive chassis of said external ground structure.

4. The electrical connector assembly of claim 1, wherein said second set of ground contacts comprise chassis ground contacts positioned in, and evenly distributed about, said top, bottom and side walls to evenly surround said electrical plug.

5. The electrical connector assembly of claim 1, wherein said ground shield further comprises a rear wall formed integral with one of said top and side walls.

6. The electrical connector assembly of claim 1, wherein said first and second sets of ground contacts are spaced different first and second longitudinal distances from said front face of said ground shield.

7. The electrical connector assembly of claim 1, wherein said first set of ground contacts includes only a single ground contact.

8. The electrical connector assembly of claim 1, wherein said second set of ground contacts includes only a single ground contact.

9. The electrical connector assembly of claim 1, wherein said first set of ground contacts includes first and second opposing ground contacts stamped in central regions of said side walls remotely positioned from said front face, said first and second opposing ground contacts engaging opposite sides of said electrical plug at first and second contact points located behind said external ground plane and within said plug ground plane.

10. The electrical connector assembly of claim 1, wherein said first set of ground contacts includes base sections punched out of said side walls, said first set of ground contacts having outer ends joining said base sections, said outer ends being bent to form ramped surfaces projecting inward, toward and facing one another.

11. The electrical connector assembly of claim 1, wherein said receptacle shield further includes a rear wall formed integral with and bent downward from said top wall to form opposed seams where said rear wall meets rear edges of said side walls, said rear wall having tabs formed integral therewith, said tabs being bent to overlap said side walls and at least partially cover said seams.

12. The electrical connector assembly of claim 1, wherein said receptacle shield further includes a rear wall having tabs on both sides of said rear wall, said tabs being integral with one of said rear and side walls, said tabs being bent to cover gaps between adjacent edges of said rear and side walls.

13. The electrical connector assembly of claim 1, further comprising a plug ground contact having a beam portion and a flexible base portion, said base portion joining said front face of said ground shield, said base portion being bent upward and inward into said opening in said front face, said beam portion defining said at least one plug ground plane.

14. The electrical connector assembly of claim 1, further comprising a plug ground contact having a beam portion extending from said opening in said front face rearward into said ground shield, said beam portion having an outer tip contacting said electrical plug to form said at least one contact point, said beam portion having sufficient length such that said outer tip of said beam portion is spaced further from said front face than said at least one contact point defining said at least one plug ground plane.

15. The electrical connector assembly of claim 1, further comprising a third set of ground contacts extending inward from said ground shield, said third set of ground contacts being adapted to form at least one second contact point with said electrical plug, said at least one second contact point defining a second plug ground plane, said second plug ground plane differing from said at least one plug ground plane.

16. An electrical connector comprising:

an insulated receptacle housing holding receptacle contacts within a receptacle opening;

a plug member connectable to said insulated receptacle housing in said receptacle opening along a longitudinal axis, said plug member holding plug contacts engaging said receptacle contacts; and a ground shield having top, bottom, side and rear walls surrounding said insulated receptacle housing and having an opening in a front face to receive said plug member, at least one of said top, bottom and side walls having ground contacts stamped and formed integral therewith, said ground contacts including a first ground contact extending outward from said ground shield and being adapted to form an external contact point with an external ground structure, said external contact point being spaced a first longitudinal distance in a first direction from said front face, said ground contacts including a second ground contact extending inward from said ground shield and being adapted to form a plug contact point with said plug member, said plug contact point being spaced a second longitudinal distance in said first direction from said front face, said second distance differing from said first distance.

17. The electrical connector of claim 16, wherein said first distance is less than said second distance.

18. The electrical connector of claim 16, wherein said second ground contact includes a plug ground contact formed integral with said front face, said plug ground contact having a flexible base portion and an outer tip portion, said outer tip portion projecting into said opening in said front face of said ground shield toward said rear wall by an amount at least equaling said second distance, said tip portion contacting said plug member to form said plug contact point.

19. The electrical connector of claim 16, further comprising a plug ground contact having a beam portion and a flexible base portion, said flexible base portion joining said front face, said base portion being bent upward and inward into said opening in said front face, said flexible beam portion extending at least said second distance from said front face into said ground shield.

20. The electrical connector of claim 16, further comprising a plug ground contact having a beam portion extending from said opening in said front face rearward into said ground shield, said beam portion having an outer tip contacting said plug member to form said plug contact point, said beam portion having sufficient length such that said plug contact point is spaced further from said front face than said first distance associated with said external contact point.

21. The electrical connector of claim 16, further comprising third ground contacts extending inward from said ground shield and being adapted to form a second plug contact point with said plug member, said second plug contact point being spaced a third distance from said front face, said third distance differing from said first and second distances.

22. The electrical connector of claim 16, wherein said second ground contact comprises multiple plug ground contacts formed integral with said side walls and projecting inward toward one another, said plug ground contacts electrically engaging opposite sides of said plug member.

23. The electrical connector of claim 16, further comprising plug ground contacts stamped and formed integral with each of said top, bottom and side walls, said plug ground contacts being evenly distributed about said ground shield.

24. An electrical connector receptacle, comprising:

an insulated housing holding receptacle contacts within a receptacle opening; and a conductive ground shield having longitudinal top, bottom, side and rear walls formed integral with one another and bent to surround said receptacle housing, said conductive ground shield having an opening in a front face and a rear face opposite said front face, said front face configured to receive a plug member having at least one conductive exterior surface, at least one of said top, bottom and side walls having ground contacts stamped and formed integral therewith, a first set of said ground contacts being configured to electrically engage a conductive chassis of a support structure at first contact points spaced a first longitudinal distance from said front face toward said rear face, a second set of said ground contacts being configured to electrically engage said plug member at second contact points spaced a second longitudinal distance from said front face toward said rear face.

25. The electrical connector of claim 24, wherein said second set of said ground contacts includes shield ground contacts formed integral with said front face, each of said shield ground contacts having a flexible base portion and an outer tip portion, said outer tip portions projecting into said opening in said front face of said ground shield by an amount at least equaling said second distance, said outer tip portions being configured to electrically engage said plug member.

26. The electrical connector of claim 24, further comprising a plug ground contact having a beam portion and a flexible base portion, said flexible base portion joining said front face, said flexible base portion being bent upward and inward into said opening in said front face, said beam portion extending at least said second distance into said ground shield.

27. The electrical connector of claim 24, further comprising a plug ground contact having a beam portion extending from said opening in said front face rearward into said ground shield, said beam portion having an outer tip electrically engaging said plug member, said beam portion having sufficient length such that said outer tip of said beam portion is spaced further from said front face than said first distance.

28. The electrical connector of claim 24, further comprising third ground contacts extending inward from said ground shield and being adapted to electrically contact said plug member at a third distance from said front face, said third distance differing from said first and second distances.

29. An electrical receptacle connector, comprising:

an insulated housing having an opening in a front end and an interior chamber holding receptacle contacts, said opening communicating with said interior chamber along a longitudinal axis, said receptacle contacts having ends extending from said housing, said opening and interior chamber being adapted to receive an electrical plug along said longitudinal axis, said electrical plug engaging said receptacle contacts;

a ground shield having top, bottom and side walls at least partially enclosing said insulated receptacle housing, said ground shield having a rear face and an opening in a front face thereof through which said electrical plug is inserted in said interior chamber, at least one of said top, bottom and side walls having first and second sets of ground contacts formed integral therewith, said first set of ground contacts projecting inward from said at least one of said top, bottom and side walls, said first set of ground contacts forming at least one plug contact point with said electrical plug to define at least one plug ground plane between said front face and said rear face, said second set of ground contacts projecting outward from said at least one of said top, bottom and side walls, said second set of ground contacts being configured to form at least one external contact point with an external ground structure to define at least one external ground plane between said front and said rear face, said external ground plane differing from said plug ground plane and being longitudinally spaced from said front face.

30. The electrical receptacle connector of claim 29, wherein said first set of ground contacts includes at least one plug ground contact formed integral with said front face, said at least one plug ground contact having a flexible base portion and an outer tip portion, said outer tip portion projecting into said opening of said ground shield by an amount at least intersecting said at least one plug ground plane, said outer tip portion forming at least one contact point.

31. The electrical receptacle connector of claim 29, further comprising a plug ground contact having a beam portion and a flexible base portion, said base portion joining said front face of said ground shield, said base portion being bent upward and inward into said opening in said front face, said beam portion intersecting at least one of said at least one plug ground plane.

32. The electrical receptacle connector of claim 29, further comprising a plug ground contact having a beam portion extending from said opening in said front face rearward into said ground shield, said beam portion having an outer tip contacting said electrical plug to form said at least one plug contact point, said beam portion having sufficient length such that said outer tip of said beam portion a distance further from said front face than said at least one plug ground plane.

33. The electrical receptacle connector of claim 29, further comprising a third set of ground contacts extending inward from said ground shield, said third set of ground contacts forming said at least one plug contact point to define a third plug ground plane, said third plug ground plane differing from said at least one plug ground plane and said at least one external ground plane.

* * * * *